US005897762A

United States Patent [19]

Liu

[11] Patent Number: 5,897,762

[45] Date of Patent: Apr. 27, 1999

[54] METHOD FOR COLORING TOOL BIT

[76] Inventor: Kuo Tien Liu, No. 6, Avenue 9, Lane 296, Prng Yii Road, Tai Ping City, Taichung Hsien, Taiwan

[21] Appl. No.: 08/837,555

[22] Filed: Apr. 21, 1997

[51] Int. Cl.[6] ..... C25D 5/48; C23C 28/00

[52] U.S. Cl. ..... 205/196; 72/47; 76/1; 205/194; 205/221; 205/222

[58] Field of Search ..... 205/191, 194, 205/196, 197, 220, 221, 222; 72/46, 47; 76/1

[56] References Cited

U.S. PATENT DOCUMENTS

| | | | |
|---|---|---|---|
| 4,204,437 | 5/1980 | Espana | 76/108 A |
| 4,268,927 | 5/1981 | Bridwell | 7/143 |
| 4,982,627 | 1/1991 | Johnson | 81/121.1 |
| 5,031,488 | 7/1991 | Zumeta | 81/180.1 |

OTHER PUBLICATIONS

H. Silman et al, Protective and Decorative Coatings for Metals, Finishing Publications Ltd., Teddington, Middlesex, England, pp. 1–3, 1978.

*Primary Examiner*—Kathryn Gorgos
*Assistant Examiner*—William T. Leader

[57] ABSTRACT

A method for coloring tool bits includes cutting a beam having a hexagonal cross section into a number of segments. The segments are electroplated for forming an outer layer on the segments. The segments each have one or two of the ends machined to form a tool bit end for engaging with fasteners. The segments are then dyed for allowing color material to be attached onto the tool bit end and for coloring the tool bit end. The electroplated outer layer may prevent the color material from attaching onto the outer peripheral portion of the segments.

2 Claims, 2 Drawing Sheets

METHOD FOR COLORING TOOL BIT

BACKGROUND OF THE INVENTION

1. Field of the Invention

The present invention relates to a method, and more particularly to a method for coloring tool bit.

2. Description of the Prior Art

Typical tool bits comprise a shaft body having one end machined to form an engaging member for engaging with the fasteners. Normally, the tool bits include a single color and may not be easily attached or applied with two or more different colors.

The present invention has arisen to mitigate and/or obviate the afore-described disadvantages of the conventional tool bits.

SUMMARY OF THE INVENTION

The primary objective of the present invention is to provide a method for coloring tool bits and for forming two or more colors in the tool bits and for allowing the tool bits to be easily distinguished from each other.

In accordance with one aspect of the invention, there is provided a method for coloring tool bits, the method comprises providing a plurality of tool bit bodies, the tool bit bodies each including at least one end, electroplating the tool bit bodies for forming an outer layer on the tool bit bodies, machining the at least one end of the tool bit bodies for forming a tool bit end, and dying the tool bit bodies for allowing color material to be attached onto the tool bit end and for coloring the tool bit end. The tool bit ends of different colors may be easily distinguished from each other.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
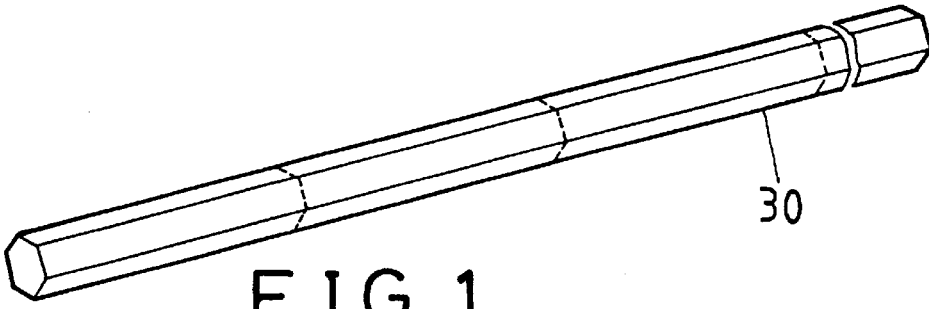
FIGS. 1, 2, 3, 4, 5 are perspective views illustrating the processes of a method in accordance with the present invention.
Figure 2:
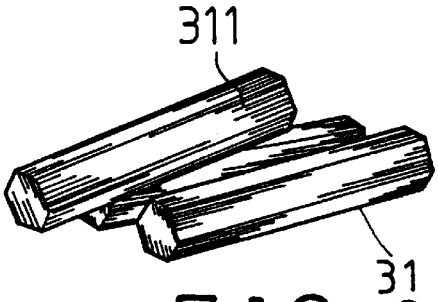
Figure 3:
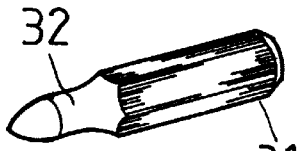
Figure 4:
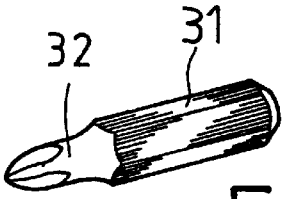
Figure 5:
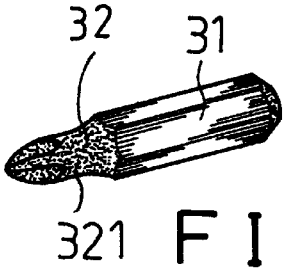
Figure 6:
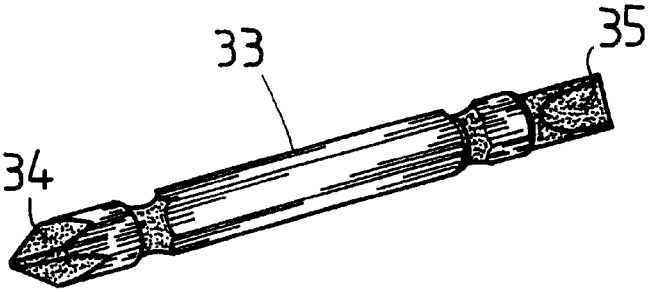
FIGS. 6, 7, 8, 9 are perspective views illustrating the other applications of the method in accordance with the present invention.
Figure 7:
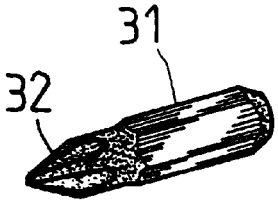
Figure 8:
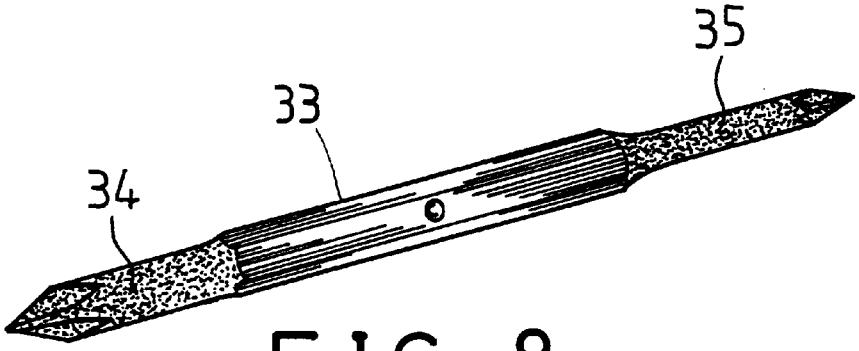
Figure 9:
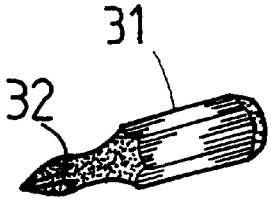

Referring to the drawings, and initially to FIGS. 1–5, a method in accordance with the present invention is provided for forming two or more colors in a tool bit. A beam 30 having a hexagonal cross section (FIG. 1) is first cut into a number of segments or tool bit bodies 31 (FIG. 2). The tool bit bodies 31 are then electroplated for forming an outer layer 311 on the outer peripheral portion of the tool bit bodies 31 (FIG. 2). The tool bit bodies 31 each has one end machined into a tool bit end 32 for engaging with the fasteners (FIGS. 3, 4). The tool bit bodies 31 are then dyed for applying another color material 321 on the tool bit end 32.

It is to be noted that the outer peripheral portion of the tool bit bodies 31 include a smooth and glossy outer layer 311 such that the color material 321 may not be applied onto the glossy outer layer 311 during the dying process. The outer layer 311 may include a color selected from bronze, silver, black, gray etc. The tool bit ends 32 are machined and are not smooth and glossy such that the color material 321 may be attached onto the tool bit ends 32 and may include various kinds of colors.

It is further to be noted that the color material may be applied onto the whole tool bit bodies 31 if the tool bit bodies 31 are not electroplated first. If the color material is applied onto the tool bit bodies 31 before the electroplating process, then the electroplating layer may not be firmly attached on the tool bit bodies 31.

Referring next to FIGS. 6–9, the tool bit bodies 31 may include tool bit ends 32 (FIGS. 7, 9) of different shape or different size. The tool bit bodies 33 (FIGS. 6, 8) may each include two tool bit ends 34, 35 formed in the end portions for engaging with different fasteners.

Accordingly, the method in accordance with the present invention may color the tool bit end with a color that is different from that of the tool bit body. The tool bit ends of different colors may be easily distinguished from each other.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for coloring tool bits, said method comprising:

providing a plurality of tool bit bodies, said tool bit bodies each including at least one end, electroplating said tool bit bodies for forming an outer layer which is glossy on the outer peripheral surface of said tool bit bodies including said at least one end, machining said at least one end of said electroplated tool bit bodies for forming a tool bit end which is not glossy, and dying said tool bit bodies for allowing color material to be attached onto said tool bit end and for coloring said tool bit end, but not attached on the remaining electroplated surface which is glossy.

2. The method according to claim 1 further comprising providing a beam having a hexagonal cross section, and cutting said beam into said plurality of tool bit bodies.

* * * * *